US010424249B2

(12) United States Patent
Zhang et al.

(10) Patent No.: US 10,424,249 B2
(45) Date of Patent: Sep. 24, 2019

(54) PIXEL DRIVING CIRCUIT AND DRIVING METHOD THEREOF, ARRAY SUBSTRATE, AND DISPLAY DEVICE

(71) Applicants: BOE Technology Group Co., Ltd., Beijing (CN); Hefei Xinsheng Optoelectronics Technology Co., Ltd., Hefei (CN)

(72) Inventors: Yang Zhang, Beijing (CN); Jinliang Liu, Beijing (CN)

(73) Assignees: BOE Technology Group Co., Ltd., Beijing (CN); Hefei Xinsheng Optoelectronics Technology Co., Ltd., Hefei (CN)

( * ) Notice: Subject to any disclaimer, the term of this patent is extended or adjusted under 35 U.S.C. 154(b) by 36 days.

(21) Appl. No.: 15/570,883

(22) PCT Filed: May 25, 2017

(86) PCT No.: PCT/CN2017/085883
§ 371 (c)(1),
(2) Date: Oct. 31, 2017

(87) PCT Pub. No.: WO2018/010495
PCT Pub. Date: Jan. 18, 2018

(65) Prior Publication Data

US 2018/0247592 A1 Aug. 30, 2018

(30) Foreign Application Priority Data

Jul. 13, 2016 (CN) ..... 2016 1 0551788

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0819* (2013.01);
(Continued)

(58) Field of Classification Search
CPC ..... H01L 27/32–27/3297; G09G 2320/045; G09G 3/3233; G09G 2300/0819; G09G 2320/043; G09G 3/3258; G09G 2320/0233
See application file for complete search history.

(56) References Cited

U.S. PATENT DOCUMENTS

2004/0174354 A1* 9/2004 Ono ..... G09G 3/3233 345/204
2005/0099412 A1* 5/2005 Kasai ..... G09G 3/325 345/204
(Continued)

FOREIGN PATENT DOCUMENTS

CN 103177685 A 6/2013
CN 103440840 A 12/2013
(Continued)

OTHER PUBLICATIONS

Aug. 23, 2017—(WO) International Search Report and Written Opinion Appn PCT/CN2017/085883 with English Tran.
(Continued)

*Primary Examiner* — Sanjiv D. Patel
(74) *Attorney, Agent, or Firm* — Banner & Witcoff, Ltd.

(57) ABSTRACT

A pixel driving circuit and a driving method thereof, an array substrate, and a display device. The pixel driving circuit includes a drift suppression unit, a data writing unit, a compensating unit, and a working unit; the drift suppression unit receives a reference control signal and a reference signal; the drift suppression unit is configured to output the reference signal to the compensating unit under control of
(Continued)

the reference control signal during a drift suppression period and a resetting period; during the drift suppression period, an electrical potential of the reference signal is smaller than zero.

18 Claims, 2 Drawing Sheets

(52) U.S. Cl.
CPC ..... *G09G 2300/0852* (2013.01); *G09G 2300/0861* (2013.01); *G09G 2300/0866* (2013.01); *G09G 2320/043* (2013.01); *G09G 2320/045* (2013.01); *G09G 2330/028* (2013.01)

(56) References Cited

U.S. PATENT DOCUMENTS

| | | | | |
|---|---|---|---|---|
| 2006/0022305 | A1* | 2/2006 | Yamashita | G09G 3/2014 257/565 |
| 2011/0227505 | A1* | 9/2011 | Park | H05B 33/0896 315/297 |
| 2013/0162617 | A1 | 6/2013 | Yoon et al. | |
| 2014/0022150 | A1 | 1/2014 | Guo et al. | |
| 2014/0184665 | A1 | 7/2014 | Yoon et al. | |
| 2016/0035276 | A1 | 2/2016 | Yin et al. | |
| 2016/0351123 | A1 | 12/2016 | Qing et al. | |
| 2016/0351125 | A1 | 12/2016 | Zhou | |
| 2017/0039948 | A1* | 2/2017 | Xu | G09G 3/325 |
| 2017/0140707 | A1 | 5/2017 | Xu et al. | |

FOREIGN PATENT DOCUMENTS

| | | | |
|---|---|---|---|
| CN | 103700342 | A | 4/2014 |
| CN | 104485074 | A | 4/2015 |
| CN | 104575392 | A | 4/2015 |
| CN | 104700783 | A | 6/2015 |
| CN | 104715726 | A | 6/2015 |
| CN | 105679250 | A | 6/2016 |
| CN | 105957474 | A | 9/2016 |

OTHER PUBLICATIONS

Dec. 4, 2017—(CN) First Office Action Appn 201610551788.4 with English Tran.

* cited by examiner

PIXEL DRIVING CIRCUIT AND DRIVING METHOD THEREOF, ARRAY SUBSTRATE, AND DISPLAY DEVICE

The application is a U.S. National Phase Entry of International Application No. PCT/CN2017/085883 filed on May 25, 2017, designating the United States of America and claiming priority to Chinese Patent Application No. 201610551788.4, filed Jul. 13, 2016. The present application claims priority to and the benefit of the above-identified applications and the above-identified applications are incorporated by reference herein in their entirety.

TECHNICAL FIELD

Embodiments of the present disclosure relate to a pixel driving circuit and a driving method thereof, an array substrate, and a display device.

BACKGROUND

Organic Light-Emitting Diode (OLED) display devices possess merits such as self-illumination, fast response, high contrast, wide viewing angle, and the like, and have become one type of display device receiving extensive attention currently.

An OLED display device comprises a plurality of pixels arranged in a matrix, each of the pixels is controlled and driven to display gray scales by a pixel driving circuit of this pixel. For conventional pixel driving circuits, image display function of the OLED display device is realized by driving corresponding OLEDs in the pixels with driving switching transistors. During the work process of a driving switching transistor, the gate electrode of the driving switching transistor can be in a state with a high bias voltage for a long time, and the physical characteristics of the driving switching transistor can become unstable under the high bias voltage for the long time, a threshold voltage drifting phenomenon for the driving switching transistor can be easily caused, and a normal output corresponding to a scan signal can be adversely affected.

SUMMARY

An embodiment of the present disclosure provides a pixel driving circuit, which comprises a drift suppression unit, a data writing unit, a compensating unit, and a working unit. The drift suppression unit is configured to receive a reference control signal and a reference signal, and to output the reference signal under the control of the reference control signal; the data writing unit is configured to receive a gate control signal, a data signal and a power supply voltage signal, and to output the data signal under the control of the gate control signal and the power supply voltage signal; the compensating unit is connected to the drift suppression unit, the data writing unit and an output node, the compensating unit is configured to receive the power supply voltage signal, to generate a driving signal, and to output the driving signal to the output node; the working unit is connected to the output node and a power supply negative pole, the working unit is configured to work under the drive of the driving signal.

Another embodiment of the present disclosure provides a driving method for a pixel driving circuit, the above-mentioned pixel driving circuit comprises: a drift suppression unit, a data writing unit, a compensating unit and a working unit, a common terminal of the compensating unit and the working unit is an output node, the driving method comprises a plurality of driving circles, each of the driving circles comprises: a drift suppression period of inputting a reference control signal and a reference signal to the drift suppression unit, such that the drift suppression unit outputs the reference signal, an electrical potential of which is smaller than zero, to the compensating unit under the control of the reference control signal; a resetting period of inputting the reference control signal and the reference signal to the drift suppression unit, such that the drift suppression unit outputs the reference signal to the compensating unit under the control of the reference control signal, so as to make the compensating unit be in a working state; and inputting a power supply voltage signal with low electrical potential to the compensating unit, so as to reset an electrical potential of the output node to an reset potential; a compensation period, inputting a gate control signal, a data signal and a power supply voltage signal with high electrical potential to the data writing unit, such that the data writing unit outputs the data signal to the compensating unit under the control of the gate control signal and the power supply voltage signal with high electrical potential; and inputting the power supply voltage signal with high electrical potential to the compensating unit, so as to increase the electrical potential of the output node to a first electrical potential from the reset potential; a data writing period, inputting the gate control signal, the data signal and the power supply voltage signal with high electrical potential to the data writing unit, such that the data writing unit outputs the data signal to the compensating unit under the control of the gate control signal and the power supply voltage signal with high electrical potential; and allowing the compensating unit to increase the electrical potential of the output node to a second electrical potential from the first electrical potential through utilizing the power supply voltage signal in a floating state; and a working period, inputting the power supply voltage signal with high electrical potential to the compensating unit, so as to allow the compensating unit to generate a driving signal under the power supply voltage signal with high electrical potential, and driving the working unit to work through utilizing the driving signal.

Further another embodiment of the present disclosure provides a pixel driving circuit, which comprises a drift suppression unit, a data writing unit, a compensating unit, a working unit, a first node and a second node. A control terminal of the compensating unit is connected to the first node, a first terminal of the compensating unit is configured to receive a power supply voltage signal, a second terminal of the compensating unit is connected to the second node; a control terminal of the drift suppression unit is configured to receive a reference control signal, a first terminal of the drift suppression unit is configured to receive a reference signal, a second terminal of the drift suppression unit is connected to the first node; a first control terminal of the data writing unit is configured to receive a gate control signal, a second control terminal of the data writing unit is configured to receive the power supply voltage signal, a first terminal of the data writing unit is configured to receive a data signal, a second terminal of the data writing unit is connected to the first node; a first terminal of the working unit is connected to the second node, a second terminal of the working unit is connected to a power supply negative pole.

Further another embodiment of the present disclosure provides an array substrate; the array substrate comprises the above-mentioned pixel driving circuit.

Further another embodiment of the present disclosure provides a display device; the display device comprises the above-mentioned array substrate.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

REFERENCE NUMERAL

1—drift suppression unit; 2—data writing unit; 3—compensating unit; 4—working unit; 5—power unit; p1—drift suppression period; p2—resetting period; p3—compensation period; p4—data writing period; p5—working period; T1—first switching transistor; T2—second switching transistor; T3—third switching transistor; T4—fourth switching transistor; Td—driving switching transistor; C1—first capacitor; C2—second capacitor; D—light emitting device; G1—reference control signal; G3—gate control signal; G4—power control signal; Data—data signal; VDD—power supply voltage signal; ELVSS—power supply negative pole; N_1 —input node; pos—output node; VSTRESS—reference signal.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

In order to further describe a pixel driving circuit and a driving method thereof, an array substrate, and a display device, the following detailed description is provided with reference to the drawings of the specification.

Figure 1A:
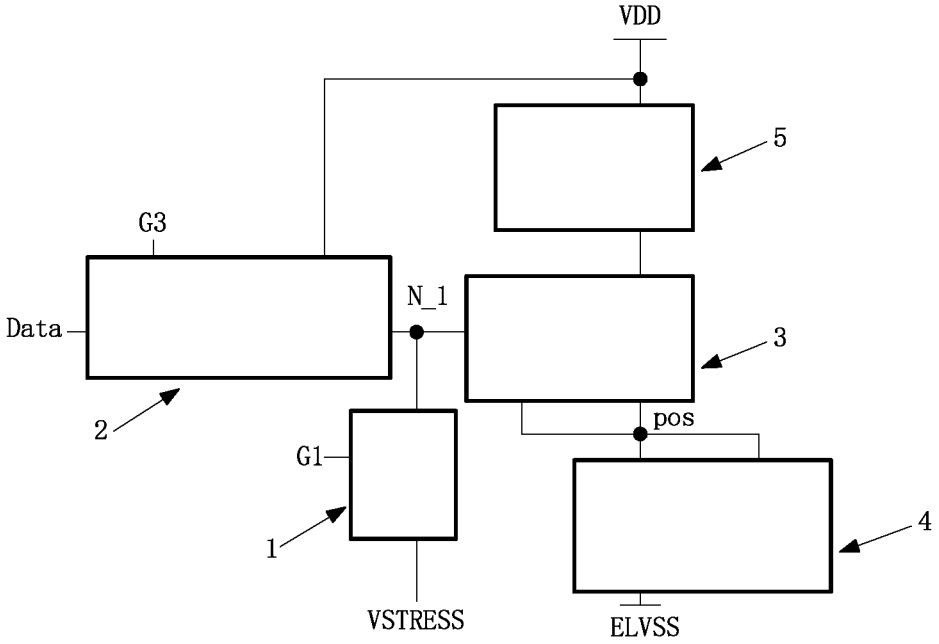
FIG. 1A is a schematically structural view of a pixel driving circuit provided by an embodiment of the present disclosure.
Figure 1B:
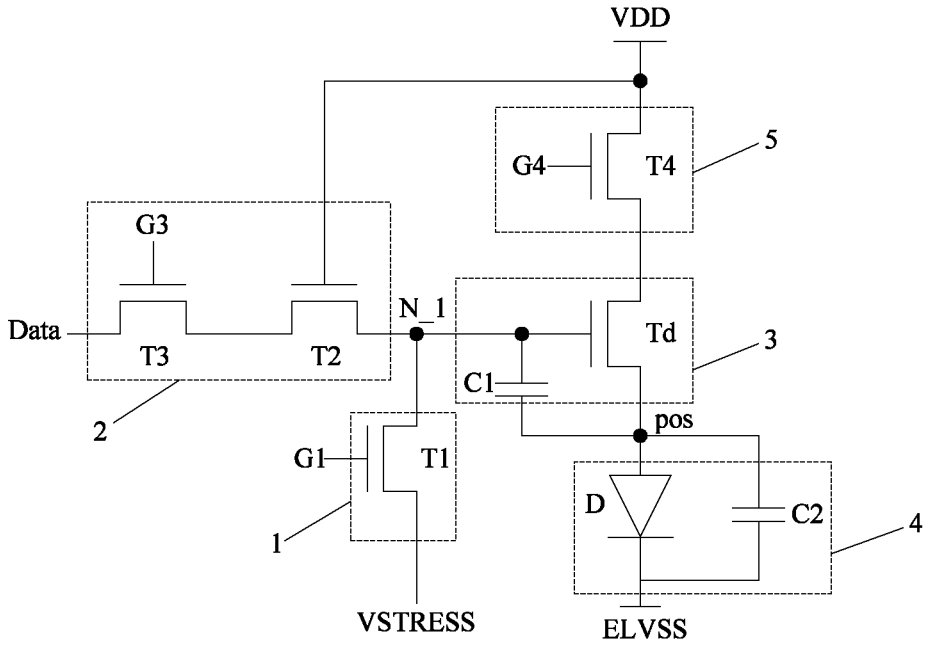
FIG. 1B is a schematically structural view of a pixel driving circuit provided by an example of an embodiment of the present disclosure.
Figure 2:
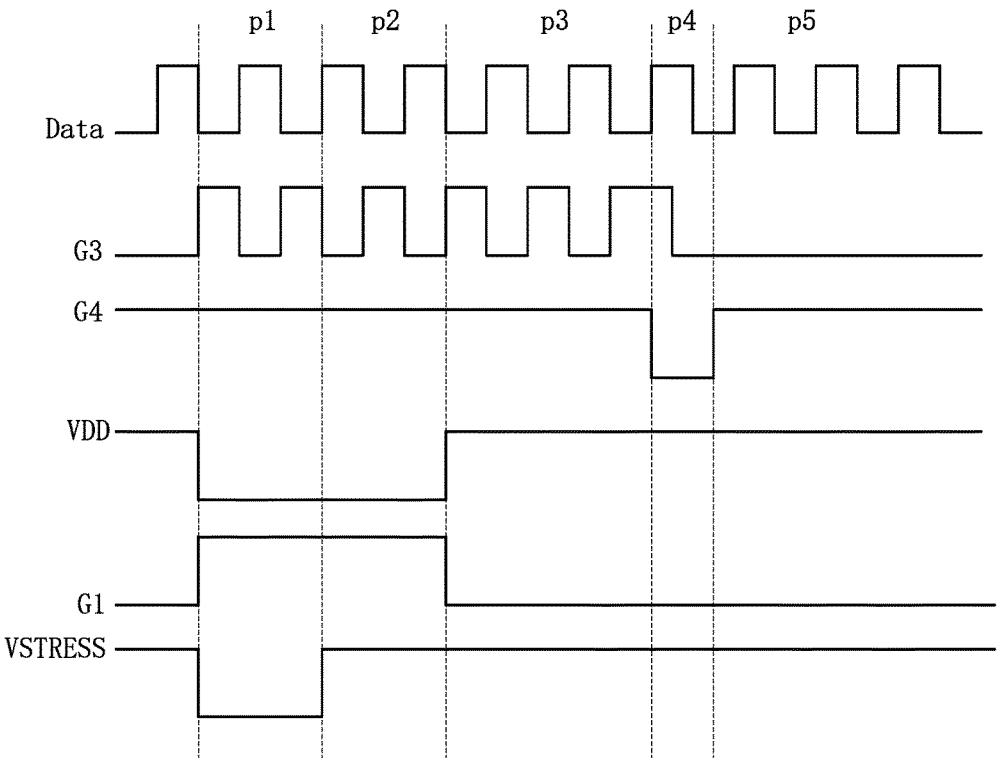
FIG. 2 is a controlling timing diagram of the pixel driving circuit provided by an embodiment of the present disclosure.

Please refer to FIG. 1A and FIG. 2, one driving circle of the pixel driving circuit provided by an embodiment of the present disclosure comprises: a drift suppression period p1, a resetting period p2, a compensation period p3, a data writing period p4, and a working period p5. The pixel driving circuit comprises: a drift suppression unit (or a drift suppression sub-circuit) 1, a data writing unit (or a data writing sub-circuit) 2, a compensating unit (or a compensating sub-circuit) 3, and a working unit (or a working sub-circuit) 4. For example, the compensating unit 3 comprises a driving switching transistor Td (refer to FIG. 1B).

The drift suppression unit 1 receives a reference control signal G1 and a reference signal VSTRESS; the drift suppression unit 1 is configured, during the drift suppression period p1 and the resetting period p2, to output the reference signal VSTRESS to an control terminal of the compensating unit 3 under the control of the reference control signal G1; furthermore, during the drift suppression period p1, for example, an electrical potential of the reference signal VSTRESS is smaller than zero; during the compensation period p3, the data writing period p4 and the working period p5, the drift suppression unit 1 outputs no signal.

The data writing unit 2 receives a gate control signal G3, a data signal Data and a power supply voltage signal VDD, an electrical potential of the data signal Data refers to a data electrical potential; the data writing unit 2 is configured, during the compensation period p3 and the data writing period p4, to output the data signal Data to the control terminal of the compensating unit 3 under the control of the gate control signal G3 and the power supply voltage signal VDD; during the drift suppression period p1, the resetting period p2 and the working period p5, the data writing unit 2 outputs no signal.

The compensating unit 3 is connected to the drift suppression unit 1, the data writing unit 2 and an output node pos, and the compensating unit 3 receives the power supply voltage signal VDD; the compensating unit 3 is configured, during the resetting period p2, to reset an electrical potential of the output node pos to an reset potential through the reference signal VSTRESS and the power supply voltage signal VDD with low electrical potential; the compensating unit 3 is configured, during the compensation period p3, to pull up the electrical potential of the output node pos to a first electrical potential from the reset potential through the data signal Data and the power supply voltage signal VDD with high electrical potential; the compensating unit 3 is configured, during the data writing period p4, to pull up the electrical potential of the output node pos to a second electrical potential from the first electrical potential through the data signal Data and the power supply voltage signal VDD in a floating state; during the working period p5, the compensating unit 3 generates a driving signal and outputs the driving signal to the output node pos under the action of the power supply voltage signal VDD with high electrical potential; the compensating unit 3 outputs no signal during the drift suppression period p1.

The working unit 4 is connected to the output node pos and connected to a power supply negative pole ELVSS as well, and the working unit 4 is configured to work under the action of the driving signal during the working period p5.

Please refer to FIG. 1 and FIG. 2, a working process of one driving cycle of the above-mentioned pixel driving circuit is described as follows.

During the drift suppression period p1, the drift suppression unit 1 receives the reference control signal G1 and the reference signal VSTRESS, the drift suppression unit 1 outputs the reference signal VSTRESS, an electrical potential of which is smaller than zero, to the compensating unit 3 under the control of the reference control signal G1.

During the resetting period p2, the drift suppression unit 1 receives the reference control signal G1 and the reference signal VSTRESS, the drift suppression unit 1 outputs the reference signal VSTRESS to the compensating unit 3 under the control of the reference control signal G1, so as to let the compensating unit 3 be in a working state, meanwhile, the compensating unit 3 receives the power supply voltage signal VDD with low electrical potential, and the operation of resetting the electrical potential of the output node pos to the reset potential is realized.

During the compensation period p3, the data writing unit 2 receives the gate control signal G3, the data signal Data, and the power supply voltage signal VDD at a high electrical potential, the data writing unit 2 outputs the data signal Data to the compensating unit 3 under the control of the gate control signal G3 and the power supply voltage signal VDD at the high electrical potential, meanwhile, the compensating unit 3 receives the power supply voltage signal VDD at the high electrical potential, and the operation of pulling up the electrical potential of the output node pos to a first electrical potential from the reset potential is realized.

During the data writing period p4, the data writing unit 2 receives the gate control signal G3, the data signal Data and the power supply voltage signal VDD with high electrical potential, the data writing unit 2 outputs the data signal Data to the compensating unit 3 under the control of the gate control signal G3 and the power supply voltage signal VDD with high electrical potential, meanwhile, the compensating unit 3 pulls up the electrical potential of the output node pos to a second electrical potential from the first electrical potential through the power supply voltage signal VDD in the floating state.

During the working period p5, the compensating unit 3 receives the power supply voltage signal VDD with high electrical potential, the compensating unit 3 generates a driving signal under the power supply voltage signal VDD with high electrical potential, and the driving signal drives the working unit 4 to work.

As understood with reference to the structure of the above-mentioned pixel driving circuit and the working process of one driving cycle of the pixel driving circuit, for the pixel driving circuit provided by the embodiment of the present disclosure, during the drift suppression period p1, the drift suppression unit 1 can output the reference signal VSTRESS, the electrical potential of which is smaller than zero, to the compensating unit 3 under the control of the reference control signal G1, and can make the electrical potential of the gate electrode of the driving switching transistor Td of the compensating unit 3 be a negative electrical potential; in a case that the electrical potential of the gate electrode of the driving switching transistor Td is a negative electrical potential, the threshold voltage Vth of the driving switching transistor Td is drifted toward a negative direction, and in a case that the threshold voltage Vth is drifted toward the negative direction, the drift degree of the threshold voltage Vth is much smaller than the drift degree of the threshold voltage Vth toward a positive direction; in this way, the electrical potential of the gate electrode of the driving switching transistor Td can be switched between the negative electrical potential and the positive electrical potential in each driving circle, the threshold voltage Vth drifting problem caused by the phenomena in which the gate electrode of the driving switching transistor Td of the compensating unit 3 operates under a high bias voltage for a long time can be well avoided, and the normal output corresponding to a scan signal can be guaranteed.

The driving switching transistor Td can be any suitable driving transistor, and this driving transistor can be an amorphous silicon transistor, a polysilicon transistor, an oxide semiconductor transistor, and the like. It should be noted that, the gate electrode of the driving switching transistor Td manufactured with oxide semiconductor can be suffered from the influence of a single bias voltage more easily; in a case that the working unit 4 is driven to work by this kind of oxide driving switching transistor Td, the threshold voltage Vth drifting problem caused by the phenomena in which the gate of the oxide driving switching transistor Td operates under a high bias voltage for a long time can be avoided for similar reasons, and a normal output corresponding to a scan signal can be guaranteed.

It should be understood that, for the pixel driving circuit provided by the embodiment of the present disclosure, the electrical potential of the power supply voltage signal VDD used by the compensating unit 3 has three kinds of states: high electrical potential state, low electrical potential state, and a floating state; the expression that the compensating unit 3 utilizes the power supply voltage signal VDD in the floating state means that the compensating unit 3 receives no power supply voltage signal VDD with any electrical potential.

Furthermore, the common terminal of the drift suppression unit 1, the data writing unit 2 and the compensating unit 3 is an input node N_1, and the common terminal of the compensating unit 3 and the working unit 4 is the output node pos.

In the following, the pixel driving circuit provided by an embodiment of the present disclosure will be described by taking the circuit structure of a specific example as illustrated in FIG. 1B as an example.

As illustrated in FIG. 1, the drift suppression unit 1 of the pixel driving circuit provided by the embodiment can comprise a first switching transistor T1, a control terminal of the first switching transistor receives the reference control signal G1, an input terminal of the first switching transistor T1 receives the reference signal VSTRESS, and an output terminal of the first switching transistor is connected to the compensating unit 3.

The data writing unit 2 can comprise a second switching transistor T2 and a third switching transistor T3; a control terminal of the second switching transistor T2 receives the power supply voltage signal VDD, an input terminal of the second switching transistor T2 is connected to an output terminal of the third switching transistor T3, and an output terminal of the second switching transistor T2 is connected to the compensating unit 3; an control terminal of the third switching transistor T3 receives the gate control signal G3, and an input terminal of the third switching transistor T3 receives the data signal Data.

The compensating unit 3 can comprise a driving switching transistor Td and a first capacitor C1, a control terminal of the driving switching transistor Td is connected to the drift suppression unit 1 and the data writing unit 2, an input terminal of the driving switching transistor Td receives the power supply voltage signal VDD, and an output terminal of the driving switching transistor Td is connected to the output node pos; a first terminal of the first capacitor C1 is connected to the control terminal the driving switching transistor Td, and a second terminal of the first capacitor C1 is connected to the output terminal of the driving switching transistor Td.

The working unit 4 can comprise a light emitting device D, an anode of the light emitting device D is connected to the output node pos, a cathode of the light emitting device D is connected to the power supply negative pole ELVSS, and the light emitting device D can emit light under the driving of the driving signal. The light emitting device D, for example, can be a light-emitting diode, which can be, for example, an organic light-emitting diode.

In another example, the working unit 4 can further comprise a second capacitor C2, a first terminal of the second capacitor is connected to the anode of the light emitting device D, a second terminal of the second capacitor C2 is connected to the cathode of the light emitting device D, so as to maintain the voltage applied to both terminals of the light emitting device D.

One driving circle of the working process of the pixel driving circuit provided by the above-mentioned embodiment comprises the following periods sequentially.

During the drift suppression period p1, the reference signal VSTRESS, the electrical potential of which is smaller than zero, is output to the compensating unit 3, so as to make the gate electrode of the driving switching transistor Td of the compensating unit 3 be in a state at a negative voltage. During this period, the reference control signal G1 is in the state at a high electrical potential, and turns on the first switching transistor T1, so as to output the reference signal VSTRESS, the electrical potential of which is smaller than zero, from the output terminal of the first switching transistor T1, such that the electrical potential $V_{N_1}$ of the input node N_1 is equal to the electrical potential of the reference signal VSTRESS (i.e., the negative electrical potential), that is, the electrical potential of the gate electrode of the driving switching transistor Td of the compensating unit 3 is at the negative electrical potential; the power supply voltage signal VDD is in the state at a low electrical potential VDD_L, so as to turn off the second switching transistor T2, such that the data writing unit 2 outputs no signal.

During the resetting period p2, the electrical potential Vpos of the output node pos is reset to the reset potential, and the information from the previous driving circle is removed. During this period, the reference control signal G1 is in the state at a high electrical potential, and turns on the first switching transistor T1, so as to output the reference signal VSTRESS (in this period, the electrical potential of the reference signal VSTRESS is larger than or equal to the threshold voltage Vth of the driving switching transistor Td) from the output terminal of the first switching transistor T1, such that the electrical potential $V_{N_1}$ of the input node N_1 is equal to the electrical potential of the reference signal VSTRESS, and the driving switching transistor Td is turned on; meanwhile, the power supply voltage signal VDD is set to be in the state at a low electrical potential VDD_L, so as to change the electrical potential Vpos of the output node pos to the reset potential (i.e., the low electrical potential VDD_L of the power supply voltage signal VDD); the gate-source voltage Vgs of the driving switching transistor Td is equal to $V_{N_1}$-Vpos and larger than Vth ($Vgs=V_{N_1}-Vpos>Vth$), such that the driving switching transistor Td is maintained to be turned on, and the electrical potential Vpos of the output node pos is maintained to be VDD_L (i.e., the reset potential); furthermore, the power supply voltage signal VDD is in the state at a low electrical potential VDD_L during this period, can turn off the second switching transistor T2 and can make the data writing unit 2 output no signal; It should be understood that, even though the driving switching transistor Td is maintained to be turned on during this period, the light emitting device D cannot be turned on to emit light because Vpos=VDD_L.

During the compensation period p3, the electrical potential Vpos of the output node pos is pulled up to the first electrical potential from the reset potential, compensating the electrical potential Vpos of the output node pos. During this period, the reference control signal G1 is in the state at a low electrical potential, and the first switching transistor T1 is turned off so that the first switching transistor T1 stops outputting the reference signal VSTRESS; meanwhile, the power supply voltage signal VDD is set to be in the state at a high electrical potential VDD_H, so that the second switching transistor T2 is turned on. Furthermore, the third switching transistor T3 is turned on and turned off periodically under the control of the gate control signal G3; in a case that the gate control signal G3 makes the third switching transistor T3 be turned on, the data signal Data_L at a low electrical potential (the low electrical potential Data_L of the data signal Data is greater than or equal to the threshold voltage Vth of the driving switching transistor Td) is outputted to the input terminal of the second switching transistor T2 from the output terminal of the third switching transistor T3, and is further outputted to the input node N_1 and the first capacitor C1 (stored in the first capacitor C1) via the output terminal of the second switching transistor T2; in a case that the gate control signal G3 makes the third switching transistor T3 be turned off, the electrical potential $V_{N_1}$ of the input node N_1 can be maintained by the data signal with low electrical potential Data_L that has been stored in the first capacitor C1 such that the turn-on state of the driving switching transistor Td during this period can be guaranteed; because during this period the power supply voltage signal VDD is in the state at the high electrical potential VDD_H and makes the driving switching transistor Td be turned on, the electrical potential Vpos of the output node pos is pulled up from the reset potential, and the gate-source voltage Vgs of the driving switching transistor Td is decreased from (Data_L-VDD_L) till Vgs=Vth, thus the driving switching transistor Td is turned off, at this moment, and the electrical potential Vpos of the output node pos is equal to Data_L-Vth, and (Data_L-Vth) refers to the first electrical potential. It should be understood that, during this period, in a case that Vgs>Vth, even though the driving switching transistor Td is turned on, the electrical potential Vpos of the output node pos is not high enough to turn on the light emitting device D to emit light. In a case that Vgs=Vth, the driving switching transistor Td is turned off, the power supply voltage signal VDD with high electrical potential VDD_H cannot be transferred to the output node pos, thus the light emitting device D still cannot emit light.

During the data writing period p4, the electrical potential Vpos of the output node pos is pulled up to the second electrical potential from the first electrical potential, so as to eliminate the influence of the threshold voltage Vth of the driving switching transistor Td on the light emitting device D. During this period, the reference control signal G1 is still in the state at a low electrical potential, that is, the first switching transistor T1 is still turned off, and the first switching transistor T1 does not output the reference signal VSTRESS; the power supply voltage signal VDD is still in the state at the high electrical potential VDD_H, such that the second switching transistor T2 is maintained to be turned on, and the third switching transistor T3 is turned on because the gate control signal G3 is in the state at a high electrical potential, such that the data signal Data_H at a high electrical potential is outputted to the input terminal of the second switching transistor T2 from the third switching transistor T3, and the data signal Data_H at the high electrical potential is further outputted to the input node N_1 and the first capacitor C1 via the second switching transistor T2, in this way the electrical potential $V_{N_1}$ of the input node N_1 becomes the high electrical potential Data_H of the data signal Data, the variation amount of the electrical potential $V_{N_1}$ of the input node N_1 is the difference between the data signal with high electrical potential Data_H and the data signal with low electrical potential Data_L (i.e., Data_H-Data_L); in the following, the gate control signal G3 is set to be in the state at a low electrical potential, and the third switching transistor T3 is turned off, and the driving switching transistor Td is maintained to be turned on by the data signal with high electrical potential Data_H that is stored in the first capacitor C1; during this period, the input terminal of the driving switching transistor Td is controlled to not receive the power supply voltage signal VDD with any electrical potential, that is, the driving switching transistor Td receives the power supply voltage signal VDD in the floating state, and the first capacitor C1 incurs the bootstrap effect, so that the electrical potential Vpos of the output node pos is bootstrapped to the second electrical potential from (Data_L-Vth); because the variation amount of the electrical potential VN_1 of the input node N_1 is (Data_H-Data_L), the variation amount of the electrical potential of the output node pos can be α (Data_H-Data_L), where α=C1/(C1+C2), and the second electrical potential Vpos=Data_L−Vth +α(Data_H-Data_L). It should be understood that, during this period, the driving switching transistor does not receive the power supply voltage signal VDD, and thus the light emitting device D emits no light.

During the working period p5, the driving switching transistor Td is turned on, and receives the power supply voltage signal VDD with high electrical potential VDD_H, so as to turn on the light emitting device D to emit light. During this period, the reference control signal G1 is in the state at a low electrical potential, and the first switching transistor T1 is turned off; the gate control signal G3 is in the state at a low electrical potential, and the third switching transistor T3 is turned off, such that the electrical potential VN_1 of the input node N_1 can be maintained at Data_H, and the driving switching transistor Td can be turned on, the electrical potential Vpos of the output node pos is maintained at [Data_L-Vth+α(Data_H-Data_L)], and the gate-source voltage Vgs of the driving switching transistor Td is at a constant value, that is:

$$Vgs=V_{N_1}-Vpos=\text{Data_}H-[\text{Data_}L\text{-}Vth+\alpha(\text{Data_}H-\text{Data_}L)] \quad \text{equation(1)}$$

$$Vgs=(1-\alpha)(\text{Data_}H-\text{Data_}L)+Vth \quad \text{equation(2)}$$

According to the following calculation equation of the working current of the light emitting device D:

$$I_D=K(Vgs-Vth)^2 \quad \text{equation(3)}$$

were K is a constant value, the following equation (4) can be obtained in a case that the equation(2) is introduced into the equation(3):

$$I_D=K[(1-\alpha)(\text{Data_}H-\text{Data_}L)+Vth-Vth]^2$$

$$I_D=K[(1-\alpha)(\text{Data_}H-Data_L)]^2 \quad \text{equation (4)}$$

With reference to the above-mentioned equation(4), the working current of the light emitting device D is not related to the threshold voltage Vth of the driving switching transistor Td any more, that is, the variation of the working current of the light emitting device D caused by the threshold voltage Vth drifting of the driving switching transistor Td can be well compensated; furthermore, it can be concluded that the working current of the light emitting device D is not related to Vdd as well with reference to the above-mentioned equation(4), that is, the variation caused by the voltage drop (IR drop) over the power source line can be compensated also; therefore, both constant brightness of the light emitting device D and working stability of the pixel driving circuit can be guaranteed by the embodiment of present disclosure.

Furthermore, during the working period p5, the input node N_1 is in the floating state, and thus the electrical potential VN_1 of the input node N_1 can be increased along with the increase of the electrical potential of the input terminal of the driving switching transistor Td, and thus the driving switching transistor Td can be turned on better, and the threshold voltage Vth of the driving switching transistor Td can be compensated better.

Furthermore, the above-mentioned specific circuit structure is only taken as an example to describe the pixel driving circuit provided by the present embodiment, in other examples of present disclosure, the drift suppression unit 1, the data writing unit 2, the compensating unit 3, and the working unit 4 of the pixel driving circuit also can be implemented in other structures respectively, and no further descriptions will be given herein.

The power supply voltage signal VDD with high electrical potential and the power supply voltage signal VDD with low electrical potential employed by the compensating unit 3 provided by the above-mentioned embodiment, for example, can be provided by an external driving chip (integrated circuit, IC, not shown in figures).

For the above-mentioned exemplary pixel driving circuit, please continue to refer to FIG. 1A, an embodiment of present disclosure can further comprise a power unit 5 connected to the compensating unit 3, the power unit 5 receives a power control signal G4 and the power supply voltage signal VDD; the power unit 5 is configured, during the drift suppression period p1 and the resetting period p2, to output the power supply voltage signal VDD with low electrical potential to the compensating unit 3 under the control of the power control signal G4; the power unit 5 is configured, during the compensation period p3 and the working period p5, to output the power supply voltage signal VDD with high electrical potential to the compensating unit 3 under the control of the power control signal G4; during the data writing period p4, the power unit 5 sets the power supply voltage signal VDD received by the compensating unit 3 to be in the floating state under the control of the power control signal G4.

The above-mentioned power unit 5 can be implemented in a variety of structures, the example as illustrated in FIG. 1B, provide one specific structure only to describe its working process in detail; apparently, the power unit 5 is not limited to the structure as illustrated in FIG. 1B.

The power unit 5 comprises a fourth switching transistor T4, a control terminal of the fourth switching transistor T4 receives the power control signal G4, an input terminal of the fourth switching transistor T4 receives the power supply voltage signal VDD, and an output terminal of the fourth switching transistor T4 is connected to the compensating unit 3. For example, the description is conducted by taking a case that the fourth switching transistor T4 is turned on by a high electrical potential and is turned off by a low electrical potential as an example, during the drift suppression period p1 and the resetting period p2, the power control signal G4 is in the state at a high electrical potential, and the fourth switching transistor T4 is turned on; the power supply voltage signal VDD is in the state at a low electrical potential $VDD_{13}$ L, and the output terminal of the fourth switching transistor T4 outputs the power supply voltage signal VDD with low electrical potential; during the compensation period p3 and the working period p5, the power control signal G4 is still in the state at the high electrical potential, and the fourth switching transistor T4 is maintained to be turned on, the power supply voltage signal VDD is in the state at a high electrical potential VDD_H, and the output terminal of the fourth switching transistor T4 outputs the power supply voltage signal VDD with high electrical potential; during the data writing period p4, the power control signal G4 in the state at the low electrical potential, the fourth switching transistor T4 is turned off, such that the electrical potential of the output terminal of the fourth switching transistor T4 is in the floating state, that is, the power supply voltage signal VDD with any electrical potential is not used by the driving switching transistor Td. Apparently, the fourth switching transistor T4 can also adopt such a switching transistor that is turned on by a low electrical potential and is turned off by a high electrical potential, in such a case, the timing diagram of the power control signal G4 of the fourth switching transistor T4 is opposite to the timing diagram of the above-mentioned power control signal G4, that is, the power control signal G4 is in the state at a high electrical potential during the data writing period p4 only, and in the state at a low electrical potential during other periods.

The above-mentioned technical solution incorporates the power unit 5, which is configured to control the input of the power supply voltage signal VDD to the compensating unit 3, and the state of the power supply voltage signal VDD can be selected only from the state at a high electrical potential and the state at a low electrical potential, that is, the influence on the data writing unit 2 and the compensating unit 3 by the power supply voltage signal VDD can be well coordinated.

In the above-mentioned descriptions, the present disclosure is described by taking N-type transistors as an example. However, those skilled in the art should be understood that the embodiment of the present disclosure can be realized with P-type transistors. For different types of transistors, voltage levels of the control voltages for the transistors should be adjusted. For example, for N-type transistors, the N-type transistors are in a turn-on state when the control signal is at a high voltage level; and the N-type transistors are in a turn-off state when the control signal is at a low voltage level. For example, for P-type transistors, the P-type transistors are in a turn-on state when the control signal is at a low voltage level; and the P-type transistors are in a turn-off state when the control signal is at a high voltage level.

In order to clearly describe the working process of the pixel driving circuit provided by the above-mentioned embodiment, the following concrete examples are provided.

First Embodiment

A switching transistor manufactured with oxide is adopted as the driving switching transistor Td of the pixel driving circuit, that is, the threshold voltage of the driving switching transistor Td is 0V.

During the drift suppression period p1, the electrical potential of the reference signal VSTRESS is set to be −16 V, so as to set the electrical potential $V_{N_1}$ of the input node N_1 to be a negative electrical potential.

During the resetting period p2, the electrical potential of the reference signal VSTRESS is increased to be 0V so as to turn on the driving switching transistor Td; meanwhile, the electrical potential of the power control signal G4 is set to be 25V so as to turn on the fourth switching transistor T4, and the low electrical potential VDD_L of the power supply voltage signal VDD is set to be −4V so as to reset the electrical potential Vpos of the output node pos to be −4V.

During the compensation period p3, the high electrical potential VDD_H of the power supply voltage signal VDD is set to be 20V, and the low electrical potential Data_L of the data signal Data is set to be 0V so as to pull up the electrical potential Vpos of the output node pos to 4V from −4V.

During the data writing period p4, the high electrical potential VDD_H of the power supply voltage signal VDD is maintained at 20V, the electrical potential of the power control signal G4 is set to be −5V, and the fourth switching transistor T4 is turned off; the gate control signal G3 is set to be 25V so as to turn on the third switching transistor T3, writing the Data_H to the gate electrode of the driving switching transistor Td based on the actual high electrical potential Data_H of the data signal Data, and pulling up the electrical potential Vpos of the output node pos to the second electrical potential.

During the working period p5, the high electrical potential VDD_H of the power supply voltage signal VDD is maintained at 20V, meanwhile, the electrical potential of the power control signal G4 is set to be 25V, and the fourth switching transistor T4 is turned on; the driving switching transistor Td is turned on, receives VDD_H at 20V so as to turn on the light emitting device D to emit light.

The embodiment of present disclosure further provides a driving method for a pixel driving circuit; the driving method is configured to drive the pixel driving circuit provided by the above-mentioned embodiments, and the above-mentioned pixel driving circuit comprises: the drift suppression unit 1, the data writing unit 2, the compensating unit 3 and the working unit 4, and the common terminal of both the compensating unit 3 and working unit 4 is the output node pos, the driving method comprises a plurality of driving circles, each of the driving circles comprises the below-described period.

During the drift suppression period p1, inputting the reference control signal G1 and the reference signal VSTRESS to the drift suppression unit 1, such that the drift suppression unit 1 outputs the reference signal VSTRESS, the electrical potential of which is smaller than zero, to the compensating unit 3 under the control of the reference control signal G1.

During the resetting period p2, inputting the reference control signal G1 and the reference signal VSTRESS to the drift suppression unit 1, such that the drift suppression unit 1 outputs the reference signal VSTRESS to the compensating unit 3 under the control of the reference control signal G1 so as to enable the compensating unit 3 to be in a working state; and inputting the power supply voltage signal VDD at a low electrical potential to the compensating unit 3 so as to reset the electrical potential of the output node pos to the reset potential.

During the compensation period p3, inputting the gate control signal G3, the data signal Data, and the power supply voltage signal VDD with high electrical potential to the data writing unit 2, and making the data writing unit 2 to input the data signal Data to the compensating unit 3 under the control of the gate control signal G3 and the power supply voltage signal VDD with high electrical potential, and inputting the power supply voltage signal VDD with high electrical potential to the compensating unit 3, so as to pull up the electrical potential of the output node pos to the first electrical potential from the reset potential.

During the data writing period p4, inputting the gate control signal G3, the data signal Data, and the power supply voltage signal VDD with high electrical potential to the data writing unit 2, such that the data writing unit 2 outputs the data signal Data to the compensating unit 3 under the control of the gate control signal G3 and the power supply voltage signal VDD with high electrical potential; and making the compensating unit 3 to pull up the electrical potential of the output node pos to the second electrical potential from the first electrical potential through the power supply voltage signal VDD in the floating state;

During the working period p5, inputting the power supply voltage signal VDD with high electrical potential to the compensating unit 3 so as to make the compensating unit 3 generate a driving signal under the power supply voltage signal VDD at the high electrical potential, and the working unit 4 is driven to work through the driving signal.

For the driving method for the pixel driving circuit provided by an embodiment of the present disclosure, during the drift suppression period p1, the drift suppression unit 1 can output the reference signal VSTRESS, the electrical potential of which is smaller than zero, to the compensating unit 3 under the control of the reference control signal G1 to allow the electrical potential of the gate electrode of the driving switching transistor Td of the compensating unit 3 to be negative electrical potential, such that the electrical potential of the gate electrode of the driving switching transistor Td can be switched between a negative electrical potential and a positive electrical potential (high electrical potential), the threshold voltage Vth drifting problem switching transistor caused by the phenomena in which the gate electrode of the driving switching transistor Td of the compensating unit 3 operates under a high bias voltage for a long time can be well avoided, and the normal output corresponding to a scan signal can be guaranteed.

The pixel driving circuit provided by the above-mentioned embodiment can further comprise the power unit 5 that is connected to the compensating unit 3, and the power unit 5 receives the power control signal G4 and the power supply voltage signal VDD; during the drift suppression period p1 and the resetting period p2, the power control signal G4 and the power supply voltage signal VDD with low electrical potential are input to the power unit 5, and the power unit 5 outputs the power supply voltage signal VDD with low electrical potential to the compensating unit 3 under the control of the power control signal G4; during the compensation period p3 and the working period p5, the power unit 5 outputs the power supply voltage signal VDD with high electrical potential to the compensating unit 3 under the control of the power control signal G4; during the data writing period p4, the power unit 5 makes the power supply voltage signal VDD received by the compensating unit 3 be in the floating state under the control of the power control signal G4.

For the above-mentioned pixel driving circuit including the power unit 5, the advantages of the driving method is described in the above-mentioned embodiment related to structures, no further description will be given herein.

The present embodiment further provides an array substrate, and the array substrate comprises one or more pixel driving circuits provided by the above-mentioned technical solutions; because the pixel driving circuits provided by the above-mentioned technical solutions can well avoid the threshold voltage Vth drifting problem caused by the phenomena in which the gate electrode of the driving switching transistor Td of the compensating unit 3 operates under a high bias voltage for a long time and can guarantee a normal output corresponding to a scan signal, and thus the array substrate provided by the present embodiment also has the above-mentioned advantages.

The present embodiment further provides a display device, the display device comprises the above-mentioned array substrate, the display device can well avoid the threshold voltage Vth drifting problem caused by the phenomena in which the gate electrode of the driving switching transistor Td of the compensating unit 3 operates under a high bias voltage for a long time and guarantee a normal output corresponding to a scan signal.

Figure 3:
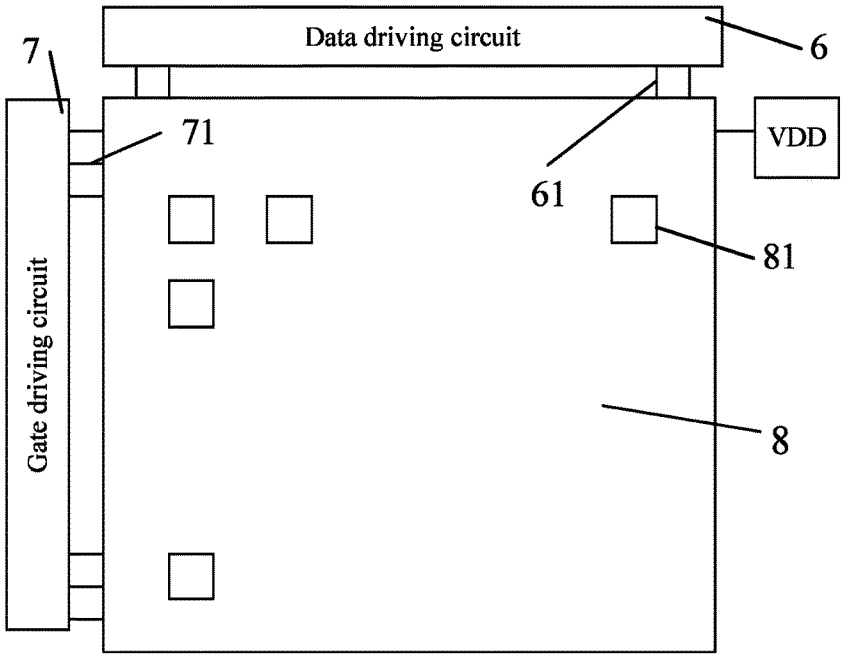
FIG. 3 is a schematic diagram of a display device provided by an embodiment of the present disclosure.

FIG. 3 is an exemplary block diagram of the display device provided by an embodiment of present disclosure, the display device comprises an array substrate 8, the array substrate 8 comprises an array including a plurality of pixel unit 81, and each pixel unit 81 comprises the pixel driving circuit provided by any one of the above-mentioned embodiments. The display device can further comprise a data driving circuit 6 and a gate driving circuit 7, which are respectively configured to provide data signals and gate control signals and the like; the display device can further comprise a chip (integrated circuit, IC) configured to provide the power supply voltage signal (Vdd) and the like. The data driving circuit 6 is connected to the pixel units 81 via the data lines 61, and the gate driving circuit 7 is connected to the pixel units 8 via gate lines 71. In a case that the light emitting device of each sub-pixel unit is an OLED, the display device can be an AMOLED.

It should be understood that the display device provided by the embodiment can be any products or device that has display function, such as an electronic paper, an OLED (Organic Light-Emitting Diode) panel, a cell phone, a tablet computer, a television, a display screen, a laptop, a digital photo frame and a navigator.

What are described above is related to the illustrative embodiments of the disclosure only and not limitative to the scope of the disclosure; the scopes of the disclosure are defined by the accompanying claims.

The application claims priority to the Chinese patent application No. 201610551788.4, filed Jul. 13, 2016, the entire disclosure of which is incorporated herein by reference as part of the present application.

What is claimed is:

1. A pixel driving circuit, comprising:

a drift suppression unit, configured to receive a reference control signal and a reference signal and to output the reference signal under control of the reference control signal;

a data writing unit, configured to receive a gate control signal, a data signal and a power supply voltage signal and to output the data signal under control of the gate control signal and the power supply voltage signal;

a compensating unit, connected to the drift suppression unit, the data writing unit and an output node and configured to receive the power supply voltage signal, generate a driving signal and output the driving signal to the output node; and a working unit, connected to the output node and a power supply negative pole and configured to work under drive of the driving signal;

wherein the data writing unit comprises a second switching transistor and a third switching transistor;

a control terminal of the second switching transistor is configured to receive the power supply voltage signal, an input terminal of the second switching transistor is connected to an output terminal of the third switching transistor, and an output terminal of the second switching transistor is connected to the compensating unit; and a control terminal of the third switching transistor is configured to receive the gate control signal, and an input terminal of the third switching transistor is configured to receive the data signal.

2. The pixel driving circuit according to claim 1, wherein the drift suppression unit comprises a first switching transistor, a control terminal of the first switching transistor is configured to receive the reference control signal, an input terminal of the first switching transistor is configured to receive the reference signal, and an output terminal of the first switching transistor is connected to the compensating unit.

3. The pixel driving circuit according to claim 1, wherein the compensating unit comprises:

a driving switching transistor, wherein a control terminal of the driving switching transistor is connected to the drift suppression unit and the data writing unit, an input terminal of the driving switching transistor is configured to receive the power supply voltage signal, and an output terminal of the driving switching transistor is connected to the output node; and a first capacitor, wherein a first terminal of the first capacitor is connected to the control terminal of the driving switching transistor, and a second terminal of the first capacitor is connected to the output terminal of the driving switching transistor.

4. The pixel driving circuit according to claim 1, wherein the working unit comprises:

a light emitting device, wherein an anode of the light emitting device is connected to the output node, a cathode of the light emitting device is connected to the power supply negative pole, and the light emitting device is configured for emitting light under drive of the driving signal.

5. The pixel driving circuit according to claim 4, wherein the working unit further comprises:

a second capacitor, wherein a first terminal of the second capacitor is connected to the anode of the light emitting device, and a second terminal of the second capacitor is connected to the cathode of the light emitting device.

6. The pixel driving circuit according to claim 1, further comprising:

a power unit, wherein the power unit is connected to the compensating unit and is configured to receive a power control signal and the power supply voltage signal.

7. The pixel driving circuit according to claim 6, wherein the power unit comprises a fourth switching transistor, wherein a control terminal of the fourth switching transistor is configured to receive the power control signal, an input terminal of the fourth switching transistor is configured to receive the power supply voltage signal, and an output terminal of the fourth switching transistor is connected to the compensating unit.

8. A driving method for a pixel driving circuit, the pixel driving circuit comprises: a drift suppression unit, a data writing unit, a compensating unit and a working unit, wherein a common terminal of the compensating unit and the working unit is an output node, the data writing unit comprises a second switching transistor and a third switching transistor; a control terminal of the second switching transistor is configured to receive a power supply voltage signal, an input terminal of the second switching transistor is connected to an output terminal of the third switching transistor, and an output terminal of the second switching transistor is connected to the compensating unit; a control terminal of the third switching transistor is configured to receive a gate control signal, and an input terminal of the third switching transistor is configured to receive a data signal; the driving method comprises a plurality of driving circles, each of the driving circles comprises:

a drift suppression period of inputting a reference control signal and a reference signal to the drift suppression unit, such that the drift suppression unit outputs the reference signal, an electrical potential of which is smaller than zero, to the compensating unit under control of the reference control signal;

a resetting period of inputting the reference control signal and the reference signal to the drift suppression unit, such that the drift suppression unit outputs the reference signal to the compensating unit under control of the reference control signal, so as to make the compensating unit be in a working state; and inputting a power supply voltage signal with low electrical potential to the compensating unit, so as to reset an electrical potential of the output node to a reset potential;

a compensation period of inputting the gate control signal, the data signal and the power supply voltage signal with high electrical potential to the data writing unit, such that the data writing unit outputs the data signal to the compensating unit under control of the gate control signal and the power supply voltage signal with high electrical potential; and inputting the power supply voltage signal with high electrical potential to the compensating unit, so as to pull up the electrical potential of the output node to a first electrical potential from the reset potential;

a data writing period of inputting the gate control signal, the data signal and the power supply voltage signal with high electrical potential to the data writing unit, such that the data writing unit outputs the data signal to the compensating unit under control of the gate control signal and the power supply voltage signal with high electrical potential; and making the compensating unit to pull up the electrical potential of the output node to a second electrical potential from the first electrical potential through the power supply voltage signal in a floating state; and a working period of inputting the power supply voltage signal with high electrical potential to the compensating unit, so as to make the compensating unit generate a driving signal under the power supply voltage signal with high electrical potential, and driving the working unit to work through the driving signal.

9. The driving method for the pixel driving circuit according to claim 8, wherein the pixel driving circuit further comprises a power unit connected to the compensating unit, the power unit is configured to receive a power control signal and the power supply voltage signal, the method comprises:

during the drift suppression period and the resetting period, inputting the power control signal and the power supply voltage signal with low electrical potential to the power unit, so as to allow the power unit to output the power supply voltage signal with low electrical potential to the compensating unit under control of the power control signal;

during the compensation period and the working period, allowing the power unit to output the power supply voltage signal with high electrical potential to the compensating unit under control of the power control signal; and during the data writing period, allowing the power unit to make the power supply voltage signal received by the compensating unit be in a floating state under control of the power control signal.

10. An array substrate, comprising the pixel driving circuit according to claim 1.

11. A display device, comprising the array substrate according to claim 10.

12. A pixel driving circuit, comprising: a drift suppression unit, a data writing unit, a compensating unit, a working unit, wherein a control terminal of the compensating unit is connected to an input node, a first terminal of the compensating unit is configured to receive a power supply voltage signal, and a second terminal of the compensating unit is connected to an output node;

a control terminal of the drift suppression unit is configured to receive a reference control signal, a first terminal of the drift suppression unit is configured to receive a reference signal, and a second terminal of the drift suppression unit is connected to the input node;

a first control terminal of the data writing unit is configured to receive a gate control signal, a second control terminal of the data writing unit is configured to receive the power supply voltage signal, and a first terminal of the data writing unit is configured to receive a data signal, a second terminal of the data writing unit is connected to the input node;

a first terminal of the working unit is connected to the output node, and a second terminal of the working unit is connected to a power supply negative pole;

the data writing unit comprises a second switching transistor and a third switching transistor;

a control terminal of the second switching transistor is configured to receive the power supply voltage signal, an input terminal of the second switching transistor is connected to an output terminal of the third switching transistor, and an output terminal of the second switching transistor is connected to the input node; and a control terminal of the third switching transistor is configured to receive the gate control signal, and an input terminal of the third switching transistor is configured to receive the data signal.

13. The pixel driving circuit according to claim 12, further comprises a power unit, wherein a control terminal of the power unit is configured to receive a power control signal, a first terminal of the power unit is configured to receive the power supply voltage signal, and a second terminal of the power unit is connected to the first terminal of the compensating unit.

14. The pixel driving circuit according to claim 12, wherein the drift suppression unit comprises a first switching transistor, wherein a control terminal of the first switching transistor is configured to receive the reference control signal, an input terminal of the first switching transistor is configured to receive the reference signal, and an output terminal of the first switching transistor is connected to the input node.

15. The pixel driving circuit according to claim 12, wherein the compensating unit comprises a driving switching transistor and a first capacitor, a control terminal of the driving switching transistor is connected to the input node, an input terminal of the driving switching transistor is configured to receive the power supply voltage signal, and an output terminal of the driving switching transistor is connected to the output node; and a first terminal of the first capacitor is connected to the input node, and a second terminal of the first capacitor is connected to the output node.

16. The pixel driving circuit according to claim 13, wherein the power unit comprises a fourth switching transistor, a control terminal of the fourth switching transistor is configured to receive the power control signal, an input terminal of the fourth switching transistor is configured to receive the power supply voltage signal, and an output terminal of the fourth switching transistor is connected to the compensating unit.

17. A driving method for the pixel driving circuit according to claim 12, comprising a plurality of driving circles, each of the driving circles comprises:

a drift suppression period of inputting the reference control signal and the reference signal to the drift suppression unit, such that the drift suppression unit outputs the reference signal, an electrical potential of which is smaller than zero, to the compensating unit under control of the reference control signal;

a resetting period of inputting the reference control signal and the reference signal to the drift suppression unit, such that the drift suppression unit outputs the reference signal to the compensating unit under control of the reference control signal, so as to make the compensating unit be in a working state; inputting the power supply voltage signal with low electrical potential to the compensating unit, so as to reset an electrical potential of the output node to a reset potential;

a compensation period of inputting the gate control signal, the data signal and the power supply voltage signal with high electrical potential to the data writing unit, such that the data writing unit outputs the data signal to the compensating unit under control of the gate control signal and the power supply voltage signal with high electrical potential; inputting the power supply voltage signal with high electrical potential to the compensating unit, so as to increase the electrical potential of the output node to a first electrical potential from the reset potential;

a data writing period of inputting the gate control signal, the data signal and the power supply voltage signal with high electrical potential to the data writing unit, such that the data writing unit outputs the data signal to the compensating unit under control of the gate control signal and the power supply voltage signal with high electrical potential; and allowing the compensating unit to pull up the electrical potential of the output node to a second electrical potential from the first electrical potential through the power supply voltage signal in a floating state; and a working period of inputting the power supply voltage signal with high electrical potential to the compensating unit, so as to allow the compensating unit to generate a driving signal under the power supply voltage signal with high electrical potential, and driving the working unit to work through the driving signal.

18. The driving method according to claim 17, wherein the pixel driving circuit further comprises a power unit connected to the compensating unit, the power unit is configured to receive a power control signal and the power supply voltage signal, the method further comprises:

during the drift suppression period and the resetting period, allowing the power unit to output the power supply voltage signal with low electrical potential to the compensating unit under control of the power control signal;

during the compensation period and the working period, outputting the power supply voltage signal with high electrical potential to the compensating unit under control of the power control signal; and during the data writing period, making the power supply voltage signal received by the compensating unit be in a floating state under control of the power control signal.

* * * * *